United States Patent [19]

Muto

[11] 4,343,320

[45] Aug. 10, 1982

[54] CIGARETTE FILTER WITH OBLIQUE PARTITIONS

[76] Inventor: Rudolph Muto, 24 Williams St., Andover, Mass. 01810

[21] Appl. No.: 238,118

[22] Filed: Feb. 25, 1981

[51] Int. Cl.[3] ..... A24D 3/04

[52] U.S. Cl. ..... 131/339; 131/336; 131/340; 131/210

[58] Field of Search ..... 131/339, 344, 336, 340, 131/341, 210

[56] References Cited

U.S. PATENT DOCUMENTS

| | | | |
|---|---|---|---|
| 2,728,346 | 12/1955 | Crawford | 131/339 |
| 3,335,733 | 8/1967 | Brooks | 131/339 |
| 3,368,566 | 2/1968 | Avedikian | 131/344 |

FOREIGN PATENT DOCUMENTS

| | | | |
|---|---|---|---|
| 69752 | 8/1941 | Czechoslovakia | 131/339 |
| 1896940 | 7/1964 | Fed. Rep. of Germany | 131/339 |
| 876669 | 9/1961 | United Kingdom | 131/339 |

*Primary Examiner*—V. Millin

*Attorney, Agent, or Firm*—Pearson & Pearson

[57] ABSTRACT

A filter assembly for cigarettes and the like comprising an elongated tube with an axial bore, having a plurality of fan folded interior cross partitions each of oval outline, and extending in a plane oblique to the axis of the bore to form a succession of sealed chambers. The oval, obliqued, cross partitions have staggered perforations to allow the filtered substance to travel to the downstream end of the tube in an undulated path. At the upstream end of the tube the exterior wall of the first sealed chamber has a pattern of intake pin holes to allow fresh air to cool the smoke. At the downstream end of the tube the sealed chamber contains aromatic unburned tobacco for restoring and enriching the flavor of the smoke. The remaining chambers contain cotton batting to filter out undesirable substances such as tar.

9 Claims, 6 Drawing Figures

Fig 1.
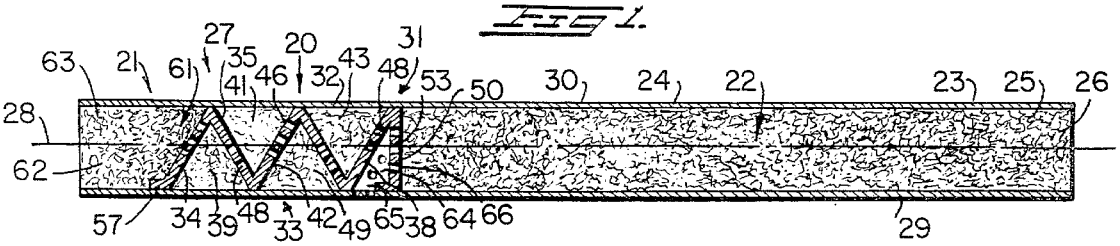
Fig 2.
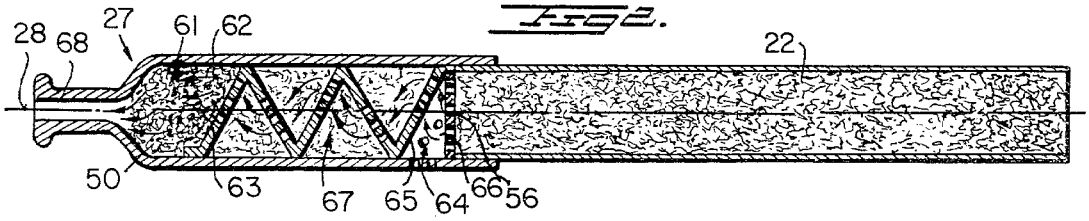
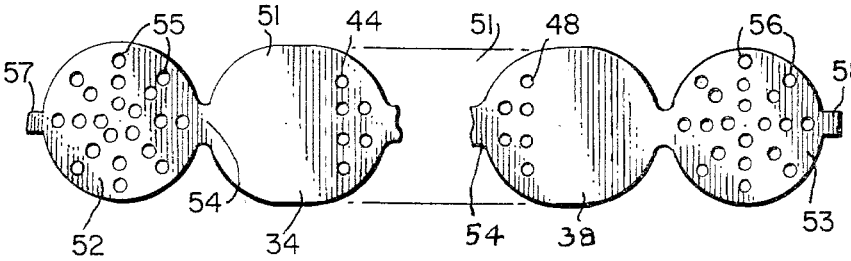
Fig 3.
Fig 4.
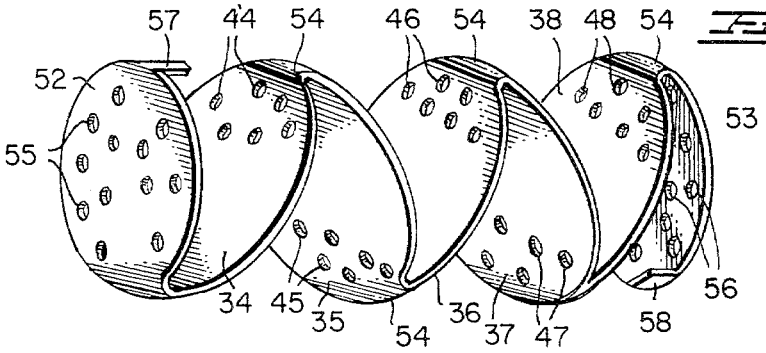
Fig 5.
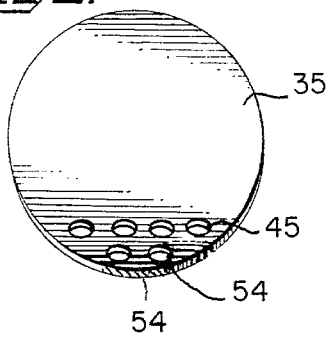
Fig 6.
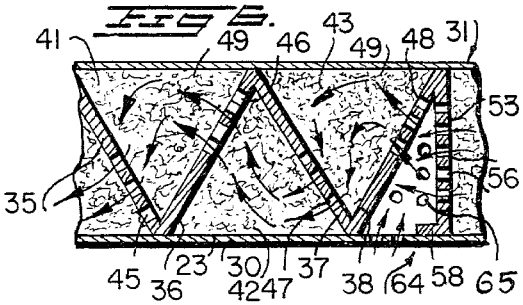

CIGARETTE FILTER WITH OBLIQUE PARTITIONS

BACKGROUND OF THE INVENTION

Many filter type assemblies have been proposed for filtering out undesirable substances such as harmful tars which are carried by the smoke from the burning tobacco to the mouth of the inhaler. Various patents have disclosed the use of tubular filter assemblies which contain cross partitions, at right angles to the exterior wall of the tube which are perforated or slotted and have filter material in the chambers formed by the cross partitions to reduce the flow of harmful tars, etc. In U.S. Pat. No. 3,079,926 to Litchfield, et al, of Mar. 5, 1963 a series of circular baffles are slotted so that the smoke can pass through each chamber. A similar series of spaced apart, circular, disc partitions, each partition having perforations staggered in relation to each other, is disclosed in U.S. Pat. No. 3,167,076 to Mare of Jan. 26, 1965.

Cup shaped partitions, or truncated conical partitions, with staggered perforations, are proposed in U.S. Pat. No. 2,764,513 to Brothers of Sept. 25, 1956 and in U.S. Pat. No. 3,759,270 to Wright of Sept. 18, 1973.

SUMMARY OF THE INVENTION

In this invention the cross partitions, spaced along the bore of the filter tube, are provided with perforations which are staggered relative to each other to guide the smoke in an undulated path through the cotton batting filled chambers. However, unlike filters of the prior art, the cross partitions are each of oval outline and each extends in a plane oblique to the central longitudinal axis of the bore to present a sloping target for impacting particles in the smoke as the smoke is drawn through the perforations.

Preferably the partitions at each opposite end are circular and extend in a plane normal to the axis of the bore, each disc like end partition having a multiplicity of perforations, in an overall pattern.

The adjacent cross partitions at the upstream end of the filter form a fresh air mixing compartment with the thin cylindrical wall of the tube, and that wall is provided with a plurality of pin hole size, air inlet apertures, or ports leading into the fresh air compartment.

The adjacent cross partitions at the downstream end of the filter form a flavor compartment with the thin cylindrical wall of the tube, the compartment being filled with fresh, unburned, aromatic tobacco.

The remaining, obliqued, adjacent oval cross partitions form a series of compartments, each loosely filled with fibrous filter material preferably cotton batting to absorb particles and harmful tars in the smoke drawn through the staggered perforations in the partitions.

BRIEF DESCRIPTION OF THE DRAWING

FIG. 1 is a side elevation in half section of a cigarette with the filter of this invention incorporated therein;

FIG. 2 is a view similar to FIG. 1 but showing a disposable filter of my invention with a cigarette inserted therein, FIG. 3 is a top plan view of a continuous web of filter paper cut into a series of ovals prior to being fan folded into the configuration shown in FIGS. 1 and 2.

FIG. 4 is a perspective view of the fan folded oval intermediate partitions and circular end partitions of the filter FIG. 5 is an end view of one of the oval partitions and FIG. 6 is an enlarged diagrammatic fragmentary side elevation in half section showing the turbulence, target impact, and deposit of tars and particles in the filter of the invention.

DESCRIPTION OF A PREFERRED EMBODIMENT

As shown in the drawing, the cigarette filter 20, of the invention, when incorporated into the tip 21 of a typical cigarette 22, includes the elongated hollow, cylindrical tube 23 formed by the cigarette paper 24, the tube 23 having unburned tobacco 25 at the upstream end 26 and the filter 20 at the downstream end 27. The cigarette paper 24, forms the thin wall 30 of the tube 23 and the numeral 28 designates the central longitudinal axis of the axial bore 29 of tube 23. The downstream end 27 is the end engaged by the mouth of the user and it is the purpose of the filter 20 to prevent undesirable substances, foreign particles, tars and the like from reaching the lungs of the user when the tobacco 25 is burned and smoke is drawn from the upstream end 31 of filter 20 through the intermediate portion 32 to the downstream end 27.

The filter 20 includes filter means 33 comprising a plurality of cross partitions 34, 35, 36, 37 and 38, each of oval outline and each extending in a plane oblique to the central longitudinal axis 28 of axial bore 29 to form a succession of substantially wedge shaped, sealed chambers with the thin wall 30 of tube 23, the chambers being designated 39, 41, 42 and 43. The partitions such as 34 are preferably formed of cigarette paper 24 and each partition contains a pattern of pin hole perforations, 44, 45, 46, 47 and 48, alternately at top and bottom, so as to be staggered relative to each other.

The wedge shaped chambers 39, 41, 42 and 43, are alternately apexed at the top and bottom, as shown, and are filled with filter material 49 preferably loosely packed cotton batting, or the like, to absorb the carcinogens, tars, and other undesirable substances in the smoke 50.

As shown in FIGS. 3, 4, and 5 the oval cross partitions 34, 35, 36, 37 and 38 are preferably formed from the flat continuous strip 51 and may have a circular partition 52 at one end as shown in FIGS. 3 and 4. The strip 51 preferably does have a circular partition 53 at the other end and a plurality of oval partitions such as 34, 35, 36 and 37 connected by the integral webs 54. The circular end partitions contain an overall pattern of pin hole perforations such as 55 and 56 to permit free passage of the filtrate smoke 50 while holding back the tobacco where necessary. The strip 51 is fan folded on fold lines at the webs 54, the fibrous filter material 49 placed in the resulting cavities and the cigarette paper 24 rolled around the tobacco and fan folds to form the cigarette. Suitable end tabs 57 and 58 may adhere the filter 20 in place.

Flavor imparting means 61 is provided comprising a supply of fresh, aromatic, unburned tobacco 62 in the chamber 63 formed at the downstream end 27 of the filter. When no circular end partition 52 is used, the web 54 becomes the end tab 57 to adhere the filter in place. Thus the filtered and cleansed smoke 50 has its taste, flavor and aroma restored and enhanced before it is inhaled by the user.

Clean air mixing means 64 is also provided in filter 20, consisting of a plurality of fresh air inlet ports 65, of pin hole size, in the thin wall 30 of the tube 23, the ports 65 leading into the fresh air mixing chamber 66 at the upstream end 31 of filter 20 formed between the circular, perforated, cross partition 53 and the adjacent oval, perforated, cross partition 38. Thus the smoke 50 from the burning of tobacco 25 is first cooled by mixing with fresh air in chamber 66 which mixing converts the carbon monoxide in the smoke to carbon dioxide. Carbon monoxide is an unstable compound when burning but converts to carbon dioxide in contact with air. This reduces the relative amount of CO from one half a percent when burning to one hundredth of one half a percent when combined with the air.

The cooled smoke from chamber 66 is then drawn in a circuitous, sinuous, undulated path through the apertures in the oval, obliqued cross partitions into the target and turbulence chambers 39, 41, 42 and 43 to impact against the sloping partitions which causes forced decantation, change of direction, change of speed and results in the undesirable particles falling to the bottom of the chambers or being absorbed by the cotton fibers in the chambers. The turbulence is depicted in FIG. 6 as the repeated filtering takes place in the successive compartments. The filtered and cleansed smoke then passes through the flavor compartment for restoration of flavor.

In FIG. 2 a filter 67 is shown, similar to filter 20, but the tube is formed by a disposable cigarette holder 68 into which the cigarette 22 may be slidably inserted. In this embodiment, all of the cross partitions are oval and obliqued, for convenience of manufacture and the holder may be discarded after the filter has become ineffective by reason of loading with undesirable filtered substances.

I claim:

1. A filter for cigarettes and the like comprising:

a hollow elongated tube having an axial bore;

a fan folded web of oval shaped cross partitions each extending in a plane oblique to the axis of said bore and forming a succession of sealed chambers along said bore;

said oval shaped, oblique cross partition having staggered perforations to alternately guide smoke through each chamber in an undulated path;

the chamber at the downstream end of said tube containing aromatic unburned tobacco to enrich the flavor of said smoke and fibrous filter material in all other said chambers to absorb and filter out undesirable substances in said smoke.

2. A filter assembly as specified in claim 1 wherein:

the wall of said tube defining part of the chamber a the upstream end of said tube contain a plurality of air intake pin holes to mix with and cool the smoke and to prevent the premature deterioration of the filter material by the smoke when it is not being inhaled through the filter assembly.

3. A cigarette filter of the type having an elongated tube with a thin cylinderical wall and an axial bore containing a series of spaced cross partitions, with perforations staggered relative to each other, the partitions forming a series of compartments each containing a filter material, characterized by each said cross partition being of oval outline and inclined in a plane oblique to the central longitudinal axis of the bore of said tube to present a sloping target surface for impacting particles in smoke advancing through said perforations in said partitions.

4. A cigarette filter as specified in claim 3 wherein:

said cross partitions of oval outline are integral with each other and fan folded from a single web of cigarette filter paper.

5. A cigarette filter as specified in claim 3 wherein:

the filter material in each said compartment is relatively loose, uncompacted, cotton batting.

6. A cigarette filter as specified in claim 3 plus:

a pair of cross partitions of circular outline, each containing an overall pattern of perforations, and each in a plane normal to the longitudinal axis of said bore, one at the upstream end of said filter, proximate the tobacco end thereto to form an upstream compartment, and the other at the downstream end of said filter, proximate the mouth engaging end, to form a downstream compartment.

7. A cigarette filter as specified in claim 6 wherein:

the thin wall of said tube contains a plurality of pin hole, fresh air, inlet ports leading into said upstream compartment for mixing fresh air with smoke to convert carbon monoxide therein to carbon dioxide while cooling said smoke.

8. A cigarette filter as specified in claim 6 wherein:

said downstream compartment is filled with fresh aromatic, unburned tobacco to restore flavor to smoke which has passed through said filter compartments.

9. A cigarette filter comprising:

an elongated hollow tube having a thin cylinderical wall, an axial bore a downstream end and an upstream end;

said tube having a plurality of cross partitions spaced along said bore, each of oval outline and each extending in a plane oblique to the axis of said bore, said obliqued, oval partitions being connected to each other by fan folds, having perforations therethrough which are staggered relative to each other, and forming a plurality of flow connected wedge shaped compartments the thin wall of said tube having a plurality of fresh air inlets, of pin hole size, leading into the compartment at the upstream end of said tube for mixing fresh air with tobacco smoke;

the compartment at the downstream end of said tube containing a supply of unburned, aromatic, tobacco for restoring flavor to smoke filtered in said flow connected compartments and the remaining said compartments containing loosely packed, absorbent cotton fibers for removing particles from said smoke.

* * * * *